US006129320A

United States Patent [19]

Warren-Pfaeffle

[11] Patent Number: 6,129,320

[45] **Date of Patent: *Oct. 10, 2000**

[54] MOTOR DRIVEN STAND-UP URINAL

[76] Inventor: Patricia E. Warren-Pfaeffle, 72 S. Charles St., Hopelawn, N.J. 08861

[ * ] Notice: This patent issued on a continued prosecution application filed under 37 CFR 1.53(d), and is subject to the twenty year patent term provisions of 35 U.S.C. 154(a)(2).

[21] Appl. No.: 08/565,888

[22] Filed: Dec. 1, 1995

[51] Int. Cl.[7] ..... A47G 29/00

[52] U.S. Cl. ..... 248/124.1; 4/420; 248/125.7

[58] Field of Search ..... 248/124.1, 125.7, 248/125.2, 176.1; 4/263, 144.1, 420; 74/59.15; 414/744.3, 744.6, 749, 751; 901/25; 187/267, 210

[56] References Cited

U.S. PATENT DOCUMENTS

| | | | |
|---|---|---|---|
| 185,004 | 12/1876 | White | 248/124.1 |
| 2,737,709 | 3/1956 | Lovelace | 187/267 X |
| 3,212,649 | 10/1965 | Johnson et al. | 414/744.6 |
| 3,481,499 | 12/1969 | Pierson et al. | 901/25 |
| 3,533,583 | 10/1970 | Azim | 248/125.2 |
| 3,835,857 | 9/1974 | Rogers, III et al. | 128/295 |
| 3,927,426 | 12/1975 | Geddes | 4/110 |
| 4,023,216 | 5/1977 | Li | 4/110 |
| 4,270,231 | 6/1981 | Zint | 4/144.1 |
| 4,306,634 | 12/1981 | Sangster | 187/267 X |
| 4,309,779 | 1/1982 | Knight | 4/144.3 |
| 4,324,317 | 4/1982 | Winkelblech | 187/267 |
| 4,490,865 | 1/1985 | Hamaguchi | 5/90 |
| 4,531,245 | 7/1985 | Lowd et al. | 4/144.3 |
| 4,769,858 | 9/1988 | Gamm et al. | 4/144.3 |
| 5,010,599 | 4/1991 | Nilsson | 4/144.2 |
| 5,085,556 | 2/1992 | Ohtomi | 414/744.3 |
| 5,161,768 | 11/1992 | Sarabin | 248/525 |
| 5,275,364 | 1/1994 | Burger et al. | 248/122 |
| 5,285,532 | 2/1994 | Sealy | 4/144.3 |

*Primary Examiner*—Anita M. King
*Assistant Examiner*—Kimberly Wood
*Attorney, Agent, or Firm*—Cobrin & Gittes

[57] ABSTRACT

A portable urinal including a urine bottle support, a hollow rod and an extension rod projecting from the hollow cylinder. The extension rod is selectively movable in a direction of elongation of the hollow cylinder by a driver. The driver is actuated remotely. The urine bottle support may be swung out of the way or into position as desired by actuating appropriate motor drives.

9 Claims, 5 Drawing Sheets

MOTOR DRIVEN STAND-UP URINAL

BACKGROUND OF THE INVENTION

The present invention relates to aids for disabled and partially disabled persons, i.e., a motorized stand-up urinal.

My copending patent application Ser. No. 08/365,071 (the '071 application), filed Dec. 27 1994, which is incorporated herein by reference, discloses a portable stand-up urinal that includes a urine bottle support having a hollow rod and an extension rod disposed within the hollow rod. The extension rod is selectively movable in its direction of elongation relative to the hollow rod. A stop screw may be provided to lock the extension in position relative to the hollow rod. The extension makes provision for supporting the urine bottle.

Disabled or partially disabled persons, who have trouble standing without an aid and generally must grasp the aid with both hands if changing position while standing, may find it awkward to adjust the height and distance of the extension disclosed in the '071 application through manual manipulation. It would therefore be desirable to adjust the relative height and distance of the extension other than through manual manipulation, thereby freeing the hands of the disabled or partially disabled person from manually positioning the extension. It would be desirable to free such persons from the need to make bending movements to effect such adjustment.

In addition, such disabled or partially disabled persons may have difficulty transferring themselves between various aids or devices, such as a wheelchair, walker and a water closet. Often, there is a gap between the aid or device which the person is going to and the aid or device that the person is leaving. As a result, the person must reach across this gap to grasp the aid or device at the other side, thereby adversely affecting the leverage that the person has to pull or carry his/her weight across the gap.

SUMMARY OF THE INVENTION

The present invention is directed to aids for disabled or partially disabled persons. One aspect of the invention resides in an aid in the form of a stand-up urinal having a motorized elongated extension arm that moves between retracted and extended positions relative to a hollow rod. The rod may be moved along a vertically extending pole between upper and lower positions and may be positioned to be swung clockwise or counterclockwise about the pole between an operative position and one clear of the operative position.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
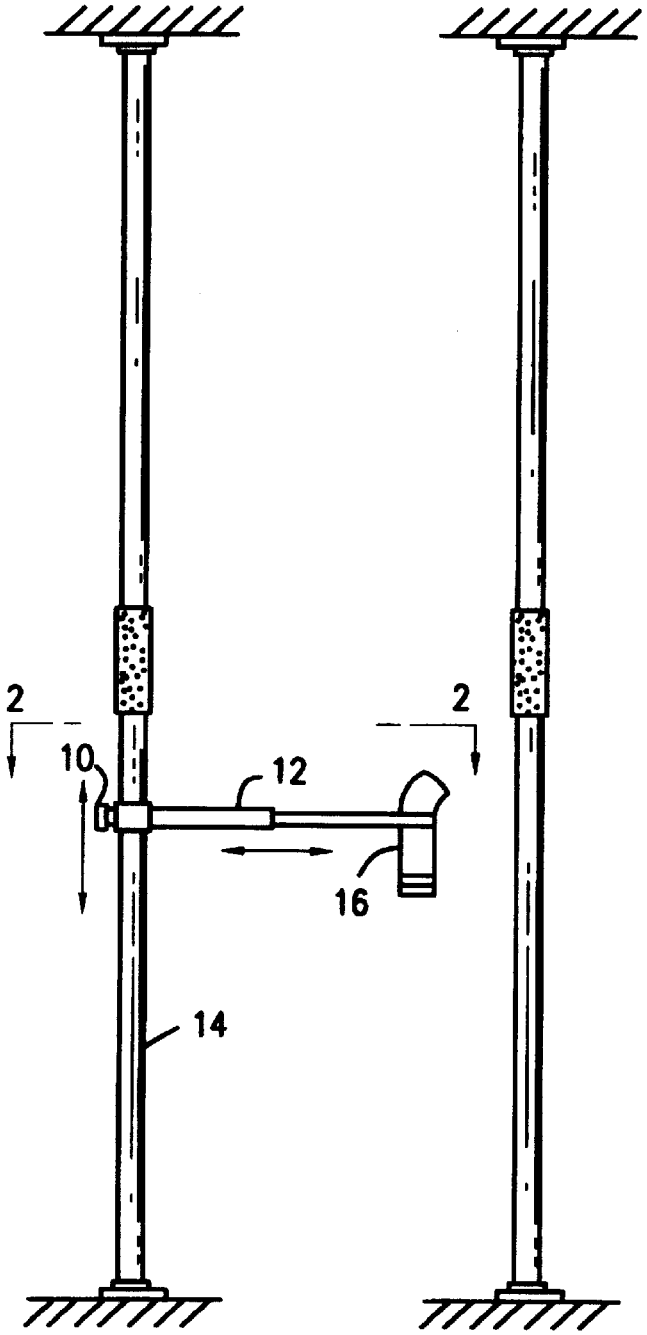
FIG. 1 is an elevational view of a portable urinal in accordance with my copending patent application Ser. No. 08/365,071, showing detail of a support pole extending between a ceiling and a floor.
Figure 2:
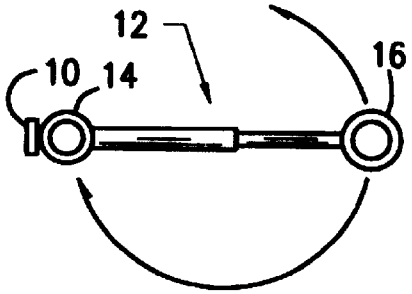
FIG. 2 is a top view of a urine bottle support as depicted in FIG. 1, showing detail of a tightening screw for height adjustment of the urine bottle support.
Figure 4:
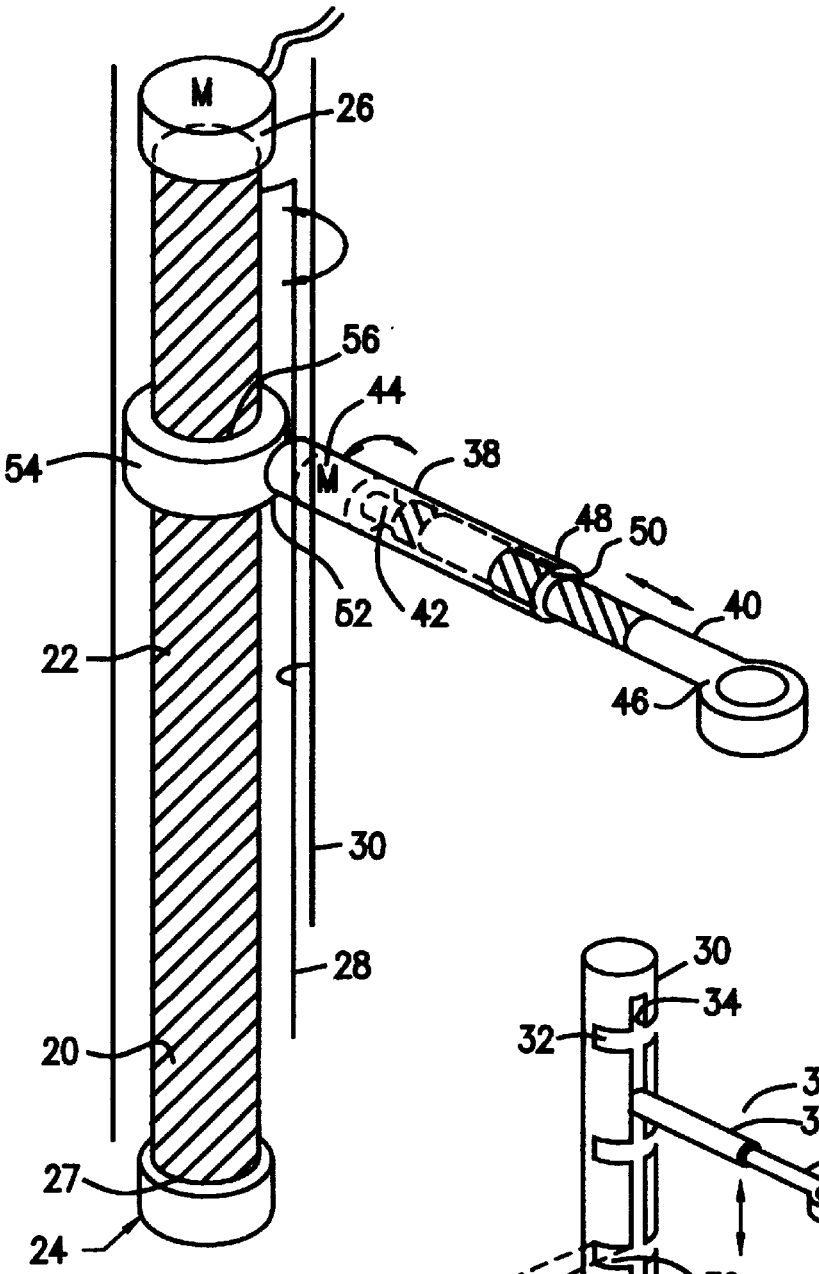
FIG. 4 is a perspective view of the stand-up urinal of FIG. 3 except that the outer cylindrical housing is broken away to reveal the internals.
Figure 3:
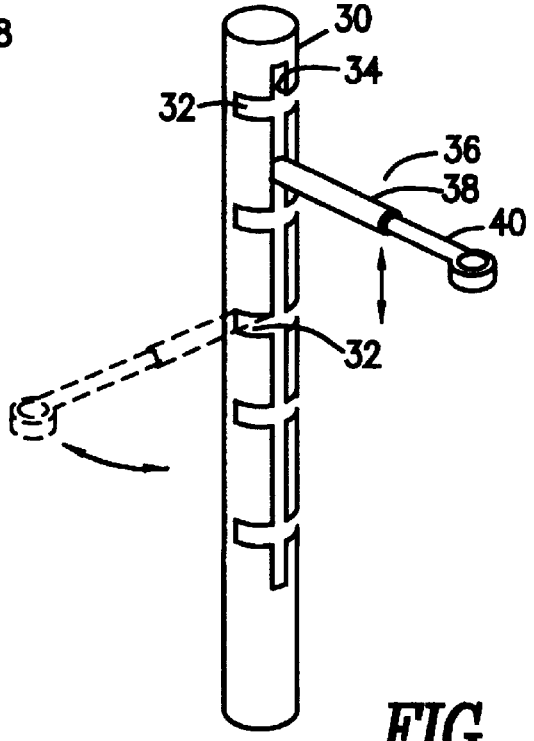
FIG. 3 is a perspective view of a stand-up urinal in accordance with the invention, with the extension arm depicted in solid and with a progressive view depicted in phantom.
Figure 5:
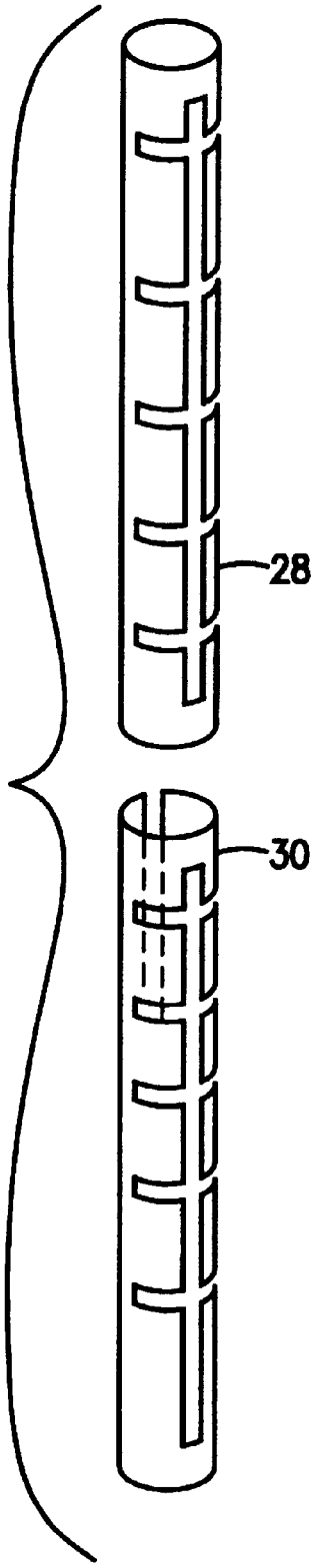
FIG. 5 is an exploded perspective view of an inner cylindrical housing and an outer cylindrical housing.
Figure 6:
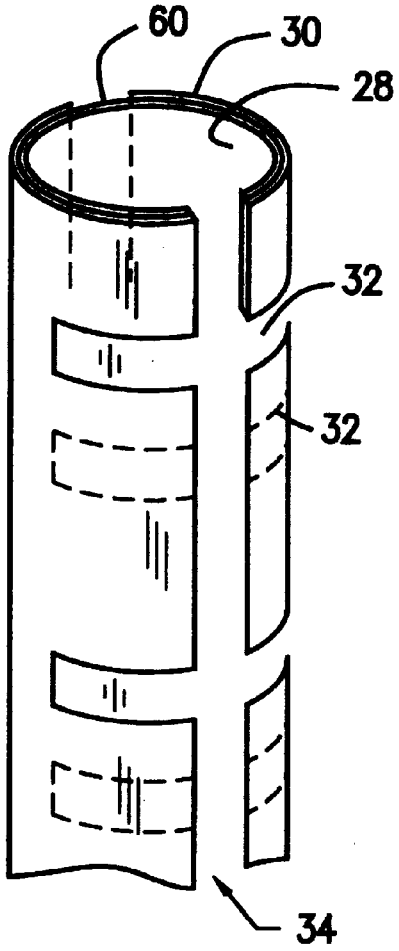
FIG. 6 is a partially broken perspective view of the inner cylindrical housing of FIG. 3 telescoped with the outer cylindrical housing of FIG. 5.

Turning to the drawings, FIGS. 1 and 2 show a portable urinal support in accordance with my copending patent application Ser. No. 08/365,071. The support is manually operated. There is a setting screw 10 for selectively locking the extension arm 12 in place. There is a standing pole 14 that extends from floor to ceiling. The extension arm 12 may be raised or lowered along the standing pole 14 to a desired height and then locked into place by the setting screw 10. The setting screw further allows the extension arm to rotate around the standing pole 14 so that if it is not needed it is out of the way of the person using the toilet (not shown, but located beneath the urine bottle 16 that is held by the extension arm 12). The standing pole 14 need not extend all the way between the floor and ceiling, but could be extend part way and be free standing.

The present invention of FIGS. 3–8 replace the setting screw and its manual manipulation with a motorized system that is remote controlled. There is a support pole 20 with an endless threaded groove 22 wrapping around the support pole 20. The pole 20 sits on a base 24. A motorized drive 26 drives the pole 20 to rotate relative to the base 24, which has bearings 27 to allow for such rotation.

Drive mechanisms, such as components that include an inner slotted cylinder 28 and an outer slotted cylinder 30 each with slots 32 and a vertically extending gap 34, are provided to translate the rotary movement of the pole 20 into linear movement of an extension arm 36 in a direction of elongation of the pole and to selectively allow rotation of the extension arm 36 in unison with the pole 20 to an extent.

A portion of the length of the pole 20 is radially surrounded by the inner slotted cylinder 28, which in turn is radially surrounded by the outer slotted cylinder 30. The slots 32 are spaced apart vertically in each and the vertically extending gaps 34 extend between central areas of each of the slots and along which vertically moves an extension arm 36. The extension arm 36 includes an elongated hollow cylinder 38 and a rod 40.

The rod 40 is driven at its proximal end 42 by a motorized driver 44 to move longitudinally in a direction of elongation of the hollow cylinder 38. The distal end 46 of the rod 40 is ring-shaped to hold a urine bottle such as the bottle 16 of FIG. 1. The distal end 48 of the hollow cylinder 38 has an entrance 50 from which projects the rod 40 outwardly. The proximal end 52 of the hollow cylinder 38 includes a ring 54 with internal teeth 56 that engage the endless threaded groove 22 on the support pole 20. If the extension arm 36 is prevented from rotating with the rotation of the threaded groove 22, then it moves either upwardly or downward depending upon whether the support pole 20 is rotating clockwise or counterclockwise. Its vertical movement is along the gap 34 that runs vertically along the inner slotted cylinder 28 and the outer slotted cylinder 30.

When the extension arm 36 is in line with the slots 32, the extension arm 36 is in a position to rotate with the rotation of the support pole 20. To achieve such alignment, the inner slotted cylinder 28 is rotated relative to the outer slotted cylinder 30 such that an end of one of its slots 32 is inline with a slot in the outer slotted cylinder 30. An end of this one slot of the inner slotted cylinder 28 is then rotated relative to the outer slotted cylinder 30 so as to engage the extension arm 36 and rotate it, as well as the support pole 20. Once the extension arm 36 is out of the way, the toilet is readily accessible by someone else. By following a reverse procedure, the extension arm 36 can thereafter be rotated back into its position for use.

Figure 7:
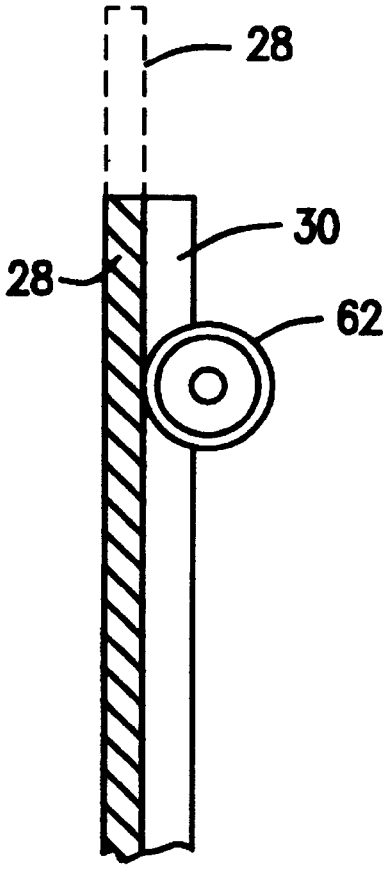
FIG. 7 is an elevational side view of a displacement mechanism for moving the inner cylindrical housing relative to the outer cylindrical housing. Also shown in phantom is a progressive view of the inner cylindrical housing.
Figure 8:
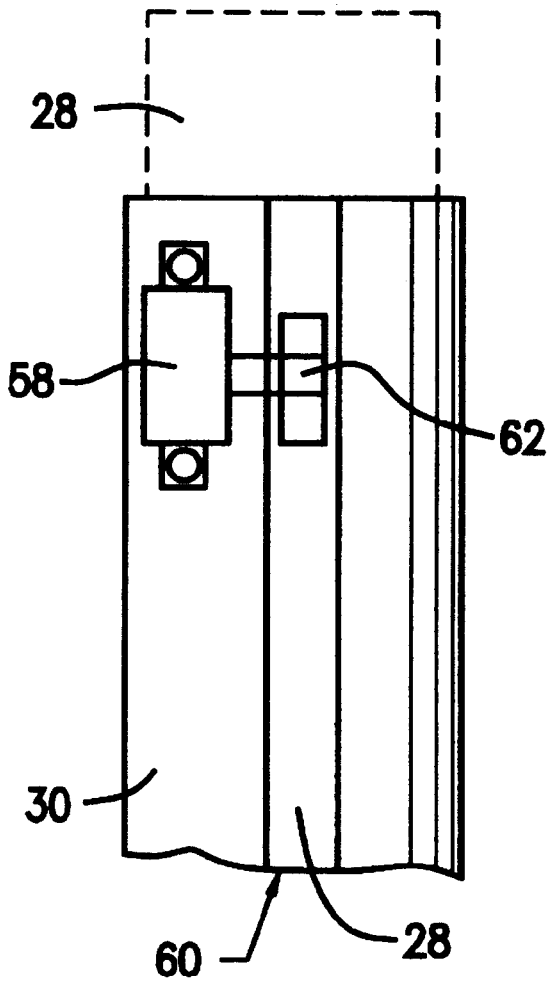
FIG. 8 is a rear view of the displacement mechanism of FIG. 7 in position for moving the inner cylindrical housing relative to the outer cylindrical housing. Also shown in phantom is a progressive view of the inner cylindrical housing.

As shown in FIGS. 7 and 8, a motorized driver 58 is secured to the outer slotted cylinder 30 adjacent an additionally vertically extending slot to drive a wheel 62 that engages the inner slotted cylinder 28 to move it in its direction of elongation relative to the outer slotted cylinder 30. Such driving is done to prevent the extension arm 36 from rotating into the slots while it is changing its elevation between upper and lower positions along the support pole 20. When it becomes desirable to move the extension arm 36 out of the way, the inner slotted cylinder 28 is moved by the wheel 62 which is rotated by the motorized driver 58, until its slots align with those on the outer slotted cylinder 30. When the slots are so aligned, rotation of the support pole 20 causes the extension arm 36 to rotate into the slots 32 and out of the way.

Thereafter, the support pole 20 may be rotated in the opposite direction to return the extension arm 36 to its position for use over the toilet. The wheel 62 may have a friction surface on its periphery to ensure contact is maintained with the inner slotted cylinder during its rotation.

The motorized drives are actuated by remote control. The remote control may have separate buttons designated for movement in each direction, i.e., up, down, outward, inward, rotate clockwise, and rotate counterclockwise. Thus, the extension arm 36 may be moved up or down after the slots 32 are moved out of alignment, the rod 20 may be moved outwardly or inwardly relative to the hollow cylinder, and the extension arm 36 may be rotated out of the way either clockwise or counterclockwise and then rotated in the opposite direction to return after the slots 32 in the inner and outer slotted cylinders 28, 30 are moved into alignment.

If necessary, additional buttons may be provided to position the slots either in or out of alignment, or this may be done automatically after pressing the other buttons that require the slots to be either aligned or out of alignment. For instance, pressing the clockwise button could first trigger the wheel 60 to rotate for a predetermined duration, causing the slots to align. Upon expiration of this duration, the motorized driver for driving the pole to rotate is actuated automatically after a time delay equal to this duration, because pressing the clockwise button also actuated a timing circuit (not shown) that controls actuation of the motorized driver 26 responsible for rotation of the support pole 20.

Figure 9:
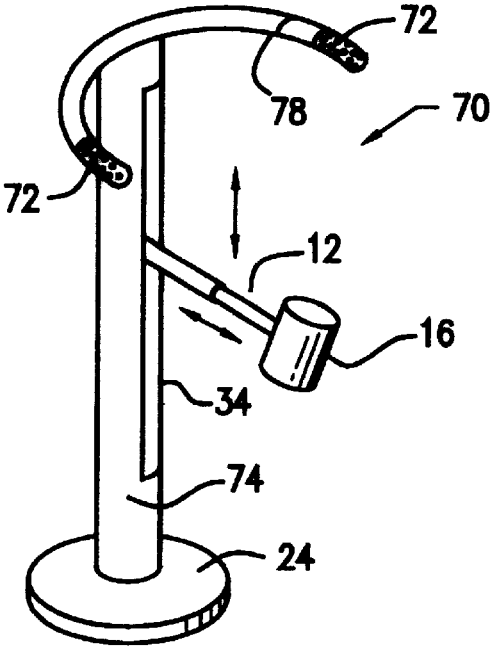
FIG. 9 is a perspective view of a free standing T-bar urinal embodiment.
Figure 10:
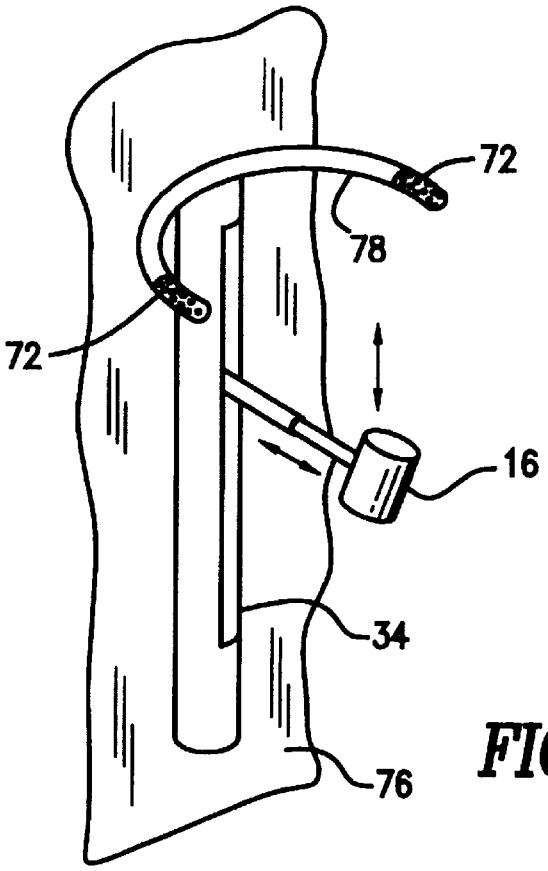
FIG. 10 is a perspective view of a further embodiment of the T-bar urinal shown fixed to a wall.

FIG. 9 incorporates the embodiment of FIGS. 3–8 into a free standing walker 70, except that provision for the inner and outer slotted cylinders are omitted. The walker has handgrips 72 and a cylindrical housing 74 radially surrounding the support pole 20 (see FIGS. 3–8), but is not rotatable with it. FIG. 10 shows a further embodiment similar to that of FIG. 9 except that instead of being part of a free standing walker, the housing 74 is attached to a wall 76 in any conventional manner such as with a fastener. For instance, the fastener may be a metal strip wrapped over the outside of the housing with its free ends secured to the wall with screws or bolts or may be an adhesive strip.

Figure 11:
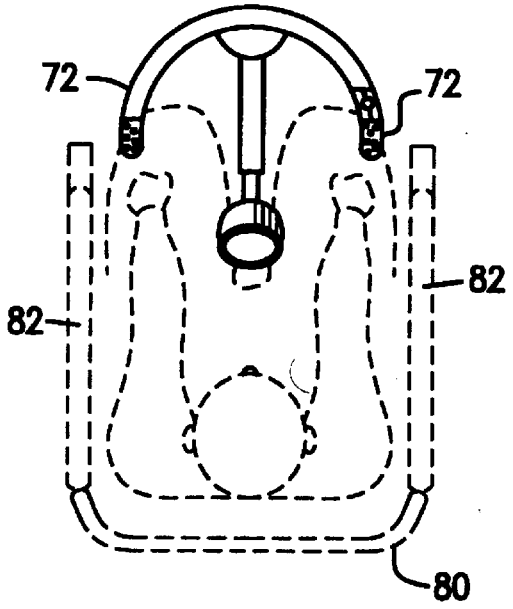
FIG. 11 is a top view of the T-bar urinal of either FIGS. 8 and 9, but also shown in phantom is a person in wheel chair.

In both embodiments of FIGS. 9 and 10, the motorized drivers may be driven by batteries and activated by buttons 78. FIG. 11 illustrates the relative position of a wheel chair with a person in preparation for use of the invention of FIGS. 9 or 10. The urine bottle 16 is positioned between and at a lower elevation than the calves of the person in the wheelchair 80. Since there is no toilet, there is no need to rotate the extension arm 36 out of the way and so no need for the inner and outer slotted cylinders of the embodiment of FIGS. 3–8.

While the foregoing description and drawings represent the preferred embodiments of the present invention, it will be understood that various changes and modifications may be made without departing from the spirit and scope of the present invention.

What is claimed is:

1. In combination, a urine bottle and apparatus to aid disabled or partially disabled persons comprising:

a urine bottle support holding the urine bottle;

an elongated rod having a distal end at which is located said urine bottle support; and a driver that drives the urine bottle support to selectively move the rod between at least two positions spaced apart from each other, wherein the rod includes an elongated hollow member and an extension rod, the extension rod having the distal end at which is located the urine bottle support, the driver driving the extension rod relative to the hollow member and thereby driving the urine bottle support between the two positions in a direction of elongation of the hollow member.

2. In combination, a urine bottle and apparatus to aid disabled or partially disabled persons comprising:

a urine bottle support holding the urine bottle;

an elongated rod having a distal end at which is located said urine bottle support;

a driver that drives the urine bottle support to selectively move the rod between at least two positions spaced apart from each other;

an elongated support pole from which extends the rod; and a drive mechanism that cooperates with the driver to move the rod in a direction of elongation of the support pole and thereby move the urine bottle support between the two positions.

3. A combination as in claim 2, wherein the driver rotates the support pole, the drive mechanism translating rotary movement of the support pole into the linear movement of the rod in the direction of elongation of the support pole.

4. A combination as in claim 2, wherein the drive mechanism includes a ring-shaped member with teeth, the support pole having a threaded groove wrapping around a surface thereof, the teeth engaging the groove, the ring-shaped member being at a proximal end of the rod.

5. A combination as in claim 2, wherein the drive mechanism includes components that selectively allow the rod to rotate in unison with rotation of the support pole and to effect the movement between the two positions dependent upon a relative position of said components.

6. A combination as in claim 2, wherein said rod includes an elongated hollow member and an extension rod movable relative to the hollow member, the extension rod having the distal end at which is the urine bottle support, further comprising a additional driver that drives the extension rod between a retracted position and an extended position relative to the hollow member.

7. A combination as in claim 6, wherein the drive mechanism includes a ring-shaped member with teeth, the support pole having a threaded groove wrapping around a surface thereof, the teeth engaging the groove, the ring-shaped member being at a proximal end of the hollow member.

8. A combination as in claim 2, further comprising a cylindrical housing radially surrounding the support pole; and two handgrips extending from the cylindrical housing and spaced apart from each other.

9. An apparatus to aid disabled or partially disabled persons, comprising:

a urine bottle support holding a urine bottle;

an elongated rod having a distal end at which is located said urine bottle support;

a driver that drives the urine bottle support to selectively move the rod between at least two positions spaced apart from each other;

an elongated support pole from which extends the rod; and a drive mechanism that cooperates with the driver to move the rod in a direction of elongation of the support pole and thereby move the urine bottle support between the two positions;

wherein the drive mechanism includes two cylindrical members one radially inside of the other and each having an elongated gap with a plurality of slots extending circumferentially therefrom separated from each other, the drive mechanism also including a driver that moves one of the two cylindrical members relative to the other in a direction of elongation of the support pole between a registry position in which the slots of both of the cylindrical members are in registry with each other and a non-registry position in which the slots of both of the cylindrical members are out of registry with each other, said rod extending through said gaps and being driveable to effect the linear movement when said cylindrical members are in said non-registry position and being rotatable about a common axis with the support pole in unison with rotation of said support pole when the cylindrical members are in the registry position.

* * * * *